United States Patent [19]

Calhoun et al.

[11] 4,160,478

[45] Jul. 10, 1979

[54] WELL TOOLS

[75] Inventors: Michael B. Calhoun, Carrollton; John V. Fredd, Dallas, both of Tex.

[73] Assignee: Otis Engineering Corporation, Dallas, Tex.

[21] Appl. No.: 904,431

[22] Filed: May 10, 1978

Related U.S. Application Data

[63] Continuation of Ser. No. 790,566, Apr. 25, 1977, abandoned.

[51] Int. Cl.[2] ..... E21B 29/00

[52] U.S. Cl. ..... 166/55.1; 166/319; 166/363; 251/315

[58] Field of Search ..... 166/55, 55.1, 54.5, 166/54.6, 297, 319, 363; 30/92, 104; 251/315

[56] References Cited

U.S. PATENT DOCUMENTS

| | | | |
|---|---|---|---|
| 3,073,388 | 1/1963 | Chenault | 166/54.5 |
| 3,817,326 | 6/1974 | Meynier | 166/55 |
| 3,870,101 | 3/1975 | Helmus | 166/54.5 X |
| 3,885,771 | 5/1975 | Baumann | 251/315 X |
| 3,926,252 | 12/1975 | Ribeyre et al. | 166/54.6 |
| 4,009,753 | 3/1977 | McGill et al. | 166/55.1 |
| 4,027,698 | 6/1977 | Weinhold | 251/315 X |

*Primary Examiner*—Stephen J. Novosad
*Assistant Examiner*—Richard E. Favreau
*Attorney, Agent, or Firm*—H. Mathews Garland

[57] ABSTRACT

A well tool for inclusion in a tubing string of a well adapted to perform multiple functions including controlling fluid flow through the tubing string and/or cutting coiled tubing or wire line used in the tubing string for performing well completion and workover functions. The tool includes a tubular body connectible in a tubing string and having a flow passage therethrough, a spherical seat surface around the flow passage developed on an eccentrically positioned center relative to the axis of the flow passage, an operator member which may function as a cutter, a valve, or a combination cutter and valve having a spherical surface engageable with the seat surface and mounted on an axis of rotation eccentrically positioned relative to the axis of the flow passage and coincident with the center of the spherical seat surface, an actuator movable longitudinally in the housing and engageable with a surface of the operator member spaced from the axis of rotation of the operator member to rotate the operator member from a first opened position to a second closed position, and return apparatus for rotating the operator member back from the second closed to the first opened position. An annular hydraulically operable piston is provided in the housing to move the actuator. The operator member is a spherical segment formed on a radius which is larger than the radius of the bore through the housing so that by pivoting the operator member eccentrically within the housing maximum torque is generated in the operator member by application of force at a substantial distance from the axis of rotation of the member by the actuator.

19 Claims, 15 Drawing Figures

WELL TOOLS

This is a continuation application of application Ser. No. 790,566 filed Apr. 25, 1977, abandoned.

This invention relates to well tools and more particularly relates to a well tool used in a tubing string during completion or workover operations for performing either or both a valve function and a cutting function for emergency severance of coiled tubing or wire line used in the well servicing operations.

In carrying out servicing operations on wells such as oil and gas wells it is standard practice to equip the surface end of the well with a blowout preventer stack and with a master flow control valve. The master valve controls fluid communication through a string of production tubing extending into the well while the rams of the blowout preventer stack are closable around the tubing string for control of fluid communication with the annulus of the well in the well casing around the tubing string. Where such a well is located offshore a riser pipe and other conduits extend from the surface platform or floating vessel to the well head structure connected in such a manner that the riser pipe and the tubing string may be quickly disconnected and removed in the event of an emergency leaving the well in a shut-in condition. Well completion and workover operations are often carried out through the blowout preventer stack and the master valve by means of operating systems of the wireline type and often using coiled tubing which is small diameter continuous tubing sufficiently flexible to be handled on reels at the surface and extendible into and retrievable from well tubing strings for fluid communication with down hole portions of a well bore. Such coil tubing is used in well testing to sample formation fluids, well treatment and stimulation procedures, sand washing, paraffin removal, and related well procedures. When emergency conditions develop particularly in offshore wells which require disconnection from the master valve and blowout preventer stack, the presence of coiled tubing or wireline extending through the master valve presents an obstacle to the closing of the master valve. The need to withdraw from the well in short time under such emergency conditions does not permit the orderly withdrawal of wireline or coiled tubing. Thus, in order to quickly close the master valve it is desirable to be able to cut the wireline or coiled tubing in the vicinity of the master valve thereby abandoning the length of wireline or coiled tubing below the master valve and permitting the wireline or coiled tubing to be pulled upwardly a few feet out of the master valve so that the master valve is closable. One proposed apparatus for cutting wireline or coiled tubing is a master valve wherein the ball valve element effects the cutting function as it rotates to the closed position. Such apparatus includes a conventional ball valve which has hydraulic assist means to aid in developing sufficient force to perform the cutting function. One particular problem with the available tools which perform the valve and cutting functions is that they employ a conventional ball type valve mounted on an axis of rotation which intersects the longitudinal axis of the tool housing and flow passage through the housing. Such arrangement minimizes the available lever arm for rotation of the ball element and thus with all conditions considered equal, minimizes the amount of force which can be applied to the ball element to perform the cutting function.

It is an object of the present invention to provide a new and improved well tool which may serve as either or both a cutter for severing a wireline or coiled tubing extending through a tubing string of the well and a flow control valve for shutting off fluid flow through the flow passage or such tubing string.

It is another object of the invention to provide a new and improved well tool connectible in a tubing string of a well and having a cutter or valve element which is rotatable by application of a greater force than can be developed with presently available tools of such type.

It is another object of the invention to provide a well tool of the character described which has a cutter and valve element mounted on an eccentrically positioned axis of rotation which permits use of a lever arm greater than the lever arm available with conventional ball shaped valve and cutter elements used in existing tools.

It is a further object of the invention to provide a well tool of the character described which uses a cutter and valve element positioned for rotation on an axis which is eccentrically located relative to the longitudinal axis of the tool and which includes a spherical surface portion formed on a radius exceeding the radius of the bore of the tool housing in which the element is mounted.

In accordance with the invention there is provided a well tool which may be connected in a tubing string of a well for either or both performing a valve function in the tubing string and providing means for cutting a wireline or coiled tubing extending through the tubing string so that the tubing string may be closed to fluid flow under emergency conditions. The apparatus of the invention includes a tubular housing connectible in a well tubing string and defining a flow passage along the tubing string, an operator element which functions either or both as a flow control valve and a cutter for severing wireline, coiled tubing, and the like extending through the housing bore, the operator element being a spherical segment having a bore alignable with the bore of the housing at a first open position and misaligned with the housing bore at a second closed position, the operator element being mounted on an axis of rotation eccentrically positioned relative and perpendicular to the longitudinal axis of the housing bore and rotatable between positions by a longitudinally movable thrust member which applies a force to the operator element at a location spaced from the axis of rotation of the element. The thrust member is driven by a hydraulic annular cylinder. A return assembly is coupled with the operator element to rotate the element from the second closed cutting position back to a first open position.

The foregoing objects and advantages together with the details of a preferred embodiment of a well tool constructed in accordance with the invention will be better understood from the following description thereof taken in conjunction with the accompanying drawings wherein:

FIG. 1 is a longitudinal schematic view showing a well tubing string including a master valve and a well tool embodying the features of the invention;

FIGS. 2A and 2B taken together form a fragmentary longitudinal view in section and elevation of a well tool constructed in accordance with the invention showing the operator element at a closed position;

FIGS. 3A and 3B taken together form a longitudinal view in section and elevation of the well tool of the invention showing the operator element at an open position;

Figure 1:
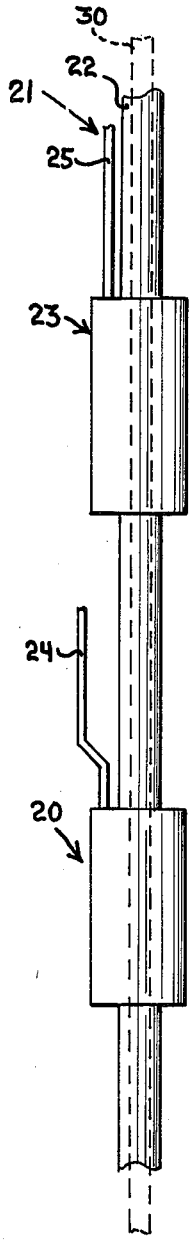

Referring to FIG. 1 of the drawings a well tool 20 including the features of the invention is connected in a well system 21 which includes a tubing string 22 and a master valve 23. A hydraulic control line 24 is connected with the well tool 20 for operation of the cutter-valve operator element of the tool while similarly a control line 25 is connected with the master valve 23 for remote fluid control of the master valve. A section of coiled tubing 30 is shown suspended in the tubing string extending through the master valve and the tool 20. The tubing string 22 is typical of a string of production tubing which may be connected to a well head assembly, not shown, which may also include a blowout preventer stack, also not shown. The tubing string may lead through a riser to a drilling vessel at the surface of the water. Facilities will normally be provided to permit disconnection of the portions of the system leading from the well head to the surface in the event that an emergency condition such as a severe storm develops. The master valve 23 is hydraulically closable under such circumstances to shut-in the well. With the coiled tubing 30 extending through the master valve as illustrated in FIG. 1 for various well servicing functions as previously discussed, the master valve is not normally closable due to the presence of the coiled tubing. One of the basic objectives of the invention is, however, achieved by operation of the well tool 20 which is capable of cutting the coiled tubing at the tool 20 so that the portion of the coiled tubing extending above the tool 20 may be lifted above the master valve 23 allowing the master valve to be fully closed. The distance between the tool 20 and the master valve generally will be only a few feet. This eliminates the necessity of having to withdraw the entire string of coiled tubing which may be on the order of several thousand feet and would require substantial time to pull from the well.

Figure 2A:
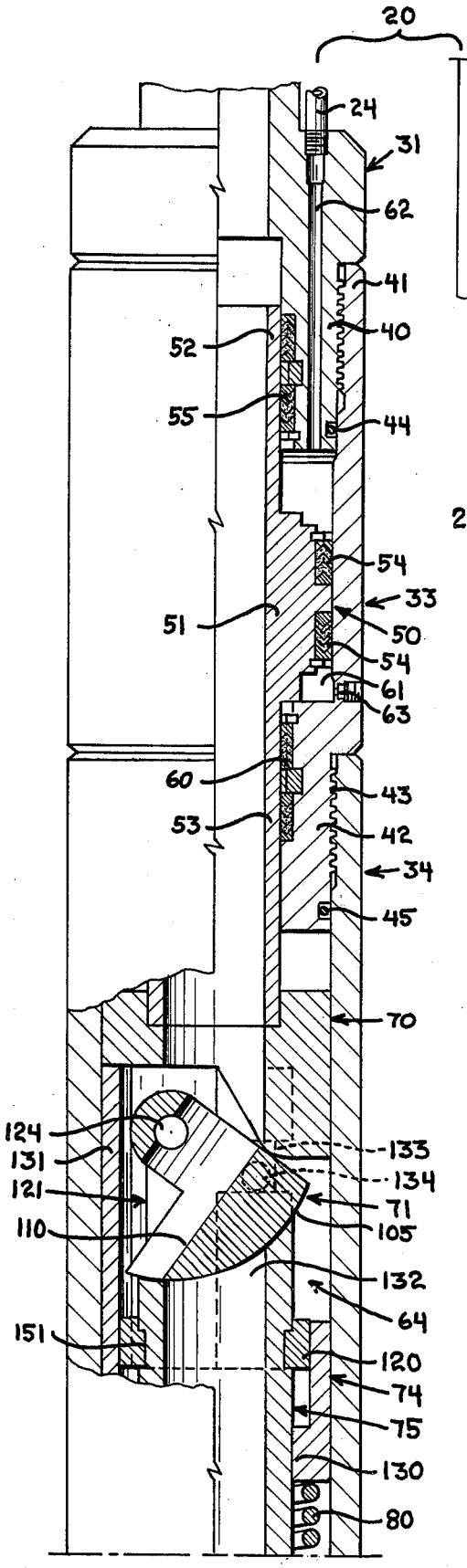
Figure 2B:
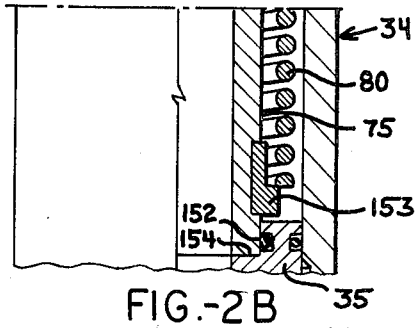
Figure 3A:
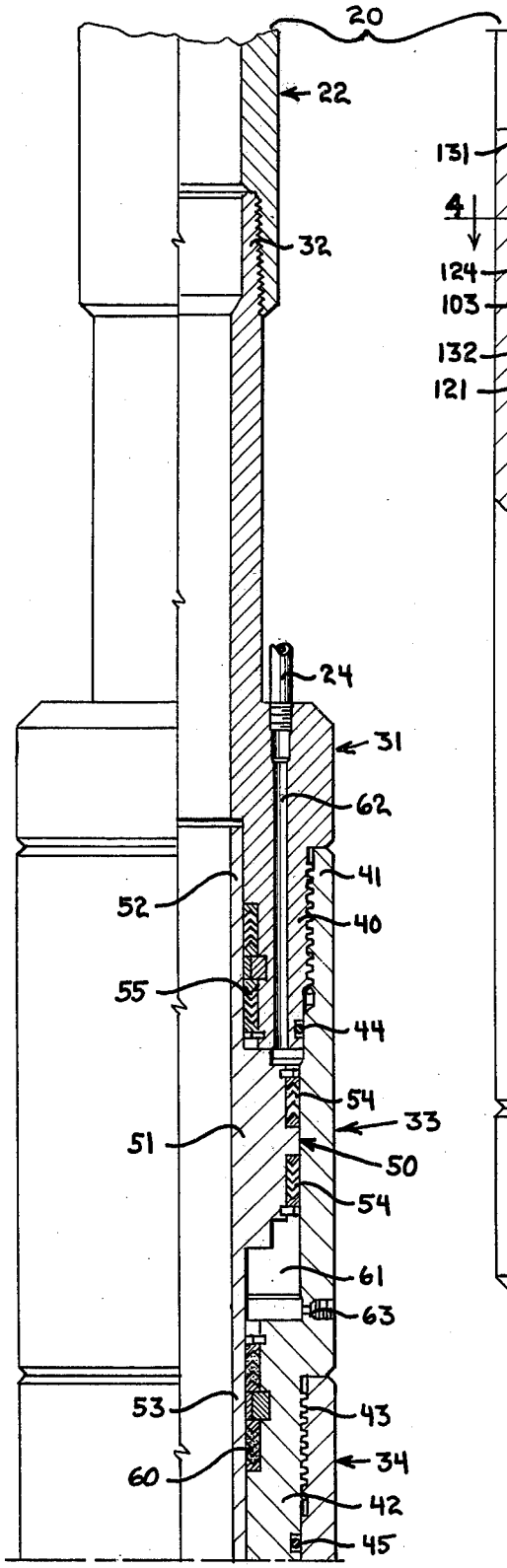
Figure 3B:
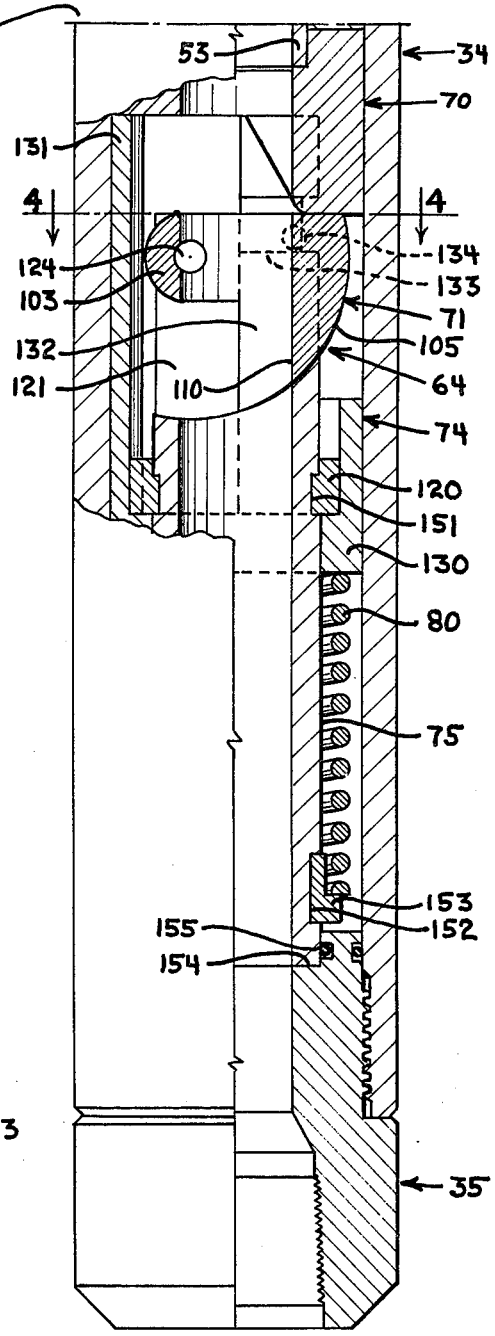

A preferred embodiment of the well tool 20 is shown in FIGS. 3A and 3B in which the cutter-valve element is illustrated open and in FIGS. 2A and 2B in which the cutter-valve element is rotated closed. Referring to FIGS. 3A and 3B the well tool 20 has a tubular housing formed by a top sub 31 having a reduced threaded upper end portion 32 engaged on the lower end of the tubing 22, a cylinder 33, a housing 34, and a bottom sub 35. The top sub 31 has a threaded reduced lower end portion 40 which is engaged in the internally threaded upper end 41 of the cylinder 33. The cylinder 33 has an externally threaded reduced lower end portion 42 which is secured into the internally threaded upper end portion 43 of the housing 34. A ring seal 44 is positioned in an external annular recess along the lower end portion 40 of the top sub 31 to seal between the top sub and the cylinder 33. Similarly, a ring seal 45 is disposed in an external annular recess around the reduced lower end portion 42 of the cylinder sealing between the cylinder and the upper end portion of the housing 34. An annular operator piston 50 is mounted for longitudinal sliding movement within the body of the tool. The piston 50 has a central portion 51 which slides within the cylinder 33, an integral reduced upper end portion 52 telescoping into the top sub 31, and a reduced lower end portion 53 telescoping into the reduced lower end portion of the cylinder 33 and into the upper end of the housing 34. Identical upper and lower seal assemblies 54 are carried by the central cylinder portion 51 to seal between the cylinder and the internal surface of the cylinder 33. A seal assembly 55 secured within the lower end portion of the top sub 31 seals between the top sub and the upper reduced end portion 52 of the cylinder. Similarly,, a seal assembly 60 is secured within the reduced lower end portion 32 of the cylinder 33 to seal between the cylinder and the reduced piston portion 53. The annular space between the piston 50 and the cylinder 33 defines a pressure chamber 61 which communicates above the central piston portion 51 with the hydraulic line 24 through a vertical flow passage 62 provided in the lower end portion of the top sub 31. The portion of the chamber 61 below the central piston section 51 communicates through a side port 63 in the cylinder 33. The port 63 may connect into the well annulus around the tool body or may be communicated with another control line, not shown, coupled into the internally threaded outer end portion of the port 63. A hydraulic operating fluid pressure directed to the tool through the line 24 enters the chamber 61 of the piston section 51 to drive the piston downwardly for operating the cutter-valve element of the tool.

Figure 13:
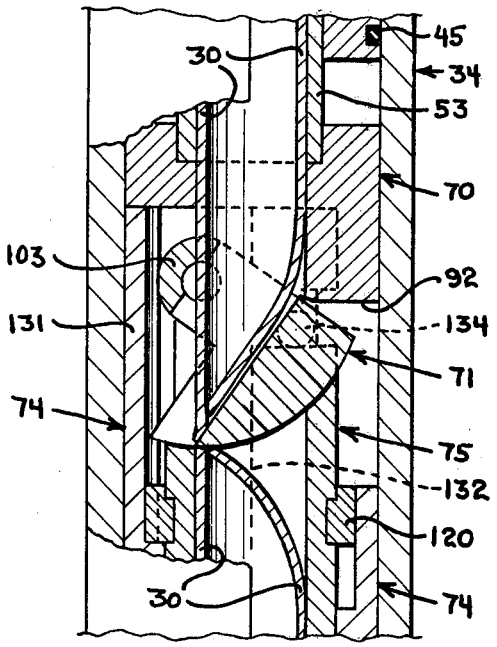
FIG. 13 is a fragmentary longitudinal view in section showing the operator element of the tool rotated to a second closed cutting position at the completion of a cut of a string of coiled tubing extending through the tube.

The annular piston 50 is moved downwardly in the tool body by hydraulic pressure communicated through the line 24 to move the cutter-valve assembly 64 of the tool from a first open position as represented in FIG. 3B to a second closed cutting position as shown in FIGS. 2A and 13. The cutter-valve assembly includes a thrust ring 70, the cutter-valve operator element 71, pivot arms 72 and 73, a carrier frame 74, a seat 75, and a return spring 80. The thrust ring 70 rotates the operator element 71 from the position in FIG. 3B to the second position of FIGS. 2A and 13 on the pivot arms 72 and 73 to the closed cutting position. The operator element rotates relative to the seat 75 which provides a seal with the element and provides a cutting surface to cooperate with the cutting surface on the operator element. The carrier frame 74 is lifted by the spring 80 to return the operator element 71 back to the open position of FIG. 3B.

Figure 8:
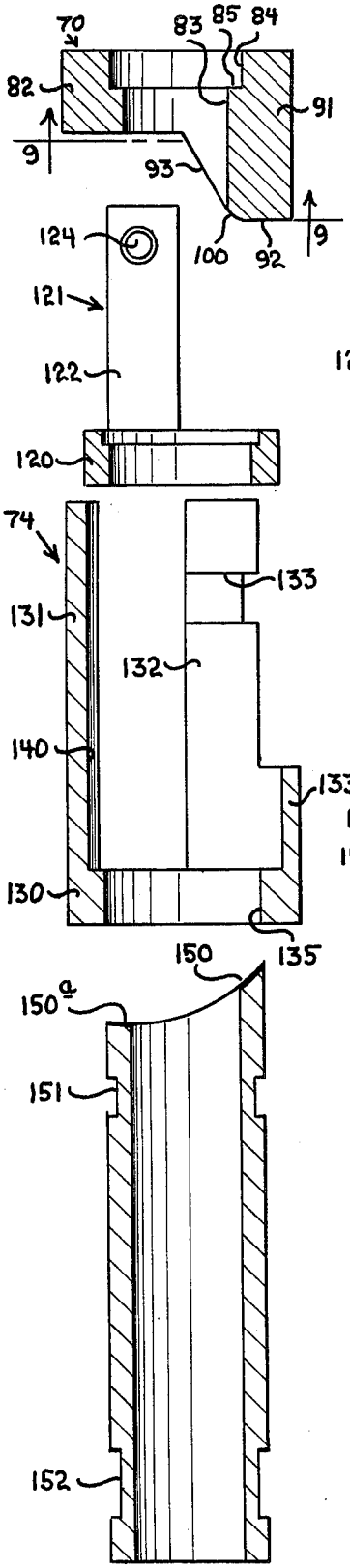
FIG. 8 is an exploded longitudinal view in section of the thrust ring, pivot arm, carrier frame, and seat for the operator element of FIGS. 5, 6 and 7.
Figure 9:
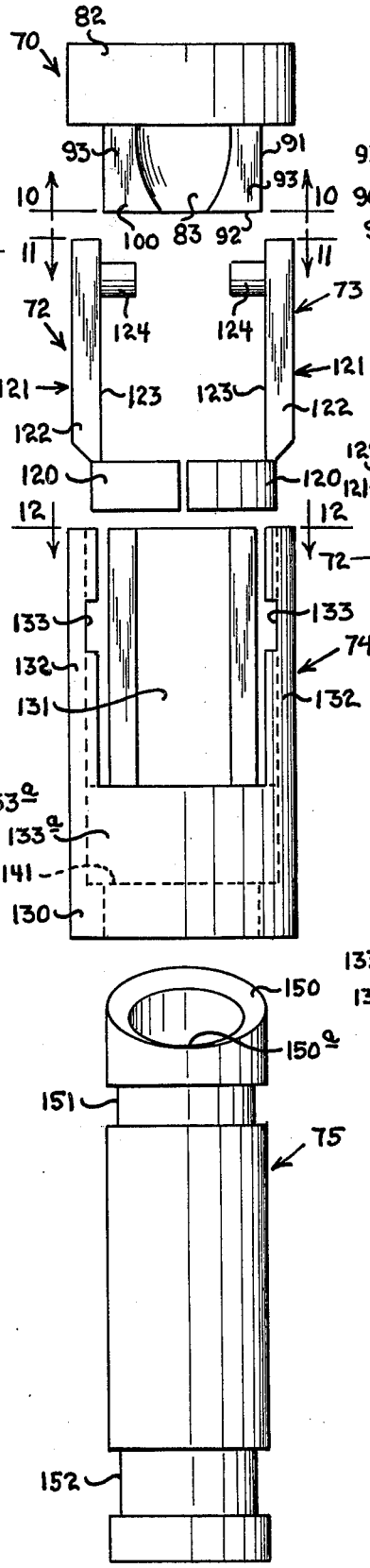
FIG. 9 is a longitudinal exploded view similar to FIG. 8 showing the thrust ring as seen along the line 9—9 of FIG. 8 in section and elevation, the pivot arms and carrier frame in elevation as viewed at 90° to the right of the view of FIG. 8, and the seat in elevation as seen at 90° to the left of FIG. 8.
Figure 10:
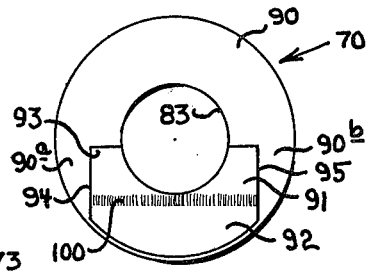
FIG. 10 is a bottom end view of the thrust ring as seen along the line 10—10 of FIG. 9.

The thrust ring as shown best in FIGS. 8, 9, and 10, has an annular ring-shaped body 82 provided with a central bore 83 and an enlarged bore portion 84 defining a shoulder 85. The lower end portion of the annular piston section 53 as shown in FIG. 3B engages the enlarged bore portion 84 of the thrust ring. The lower end edge of the annular piston section 53 seats on the thrust ring shoulder 85 driving the thrust ring downwardly. The body 82 of the thrust ring has a bottom face 90 including side portions 90*a* and 90*b* all of which lie in a common plane. An integral wedge portion 91 is formed on the body of the thrust ring. The wedge portion has a bottom face 92, an upwardly and inwardly sloping face 93, and side faces 94 and 95 which extend perpendicular to the face portions 90*a* and 90*b* of the face 90. The sloping portion 93 angles upwardly and inwardly toward the axis of the ring as evident in FIG. 8. The sloping face 93 slopes upwardly and inwardly at about a 60° angle as viewed in FIG. 8. The sloping face 93 connects with the bottom end face 92 by a corner surface 100 which is a rounded surface formed on a suitable radius to provide a smooth transition from the bottom face 92 to the sloping face 93. A operating wedge or ramp for engaging and rotating the operator element 71 is thereby defined by the end edge 92, the sloping inner face 93, the joining corner edge 100, and the side faces 94 and 95.

Figure 4:
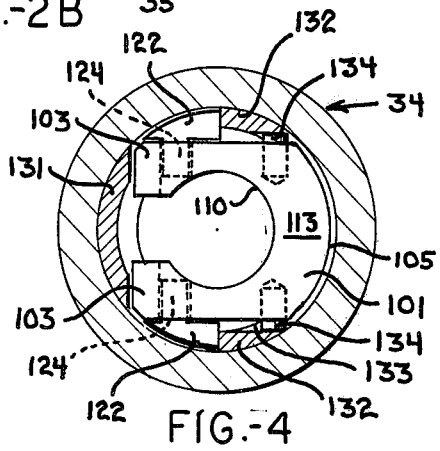
FIG. 4 is a view in section and elevation along the line 4—4 of FIG. 3B.
Figure 5:
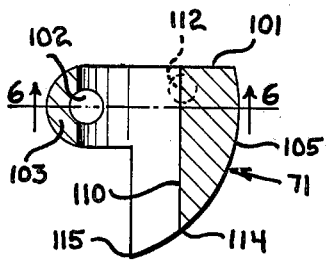
FIG. 5 is a side view in section of the operator element of the well tool.
Figure 6:
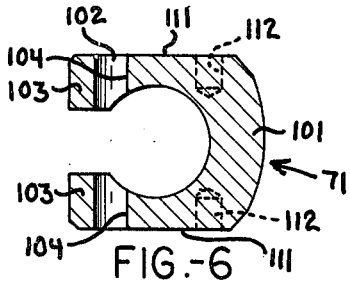
FIG. 6 is a view in section of the operator element as viewed along the line 6—6 of FIG. 5.
Figure 7:
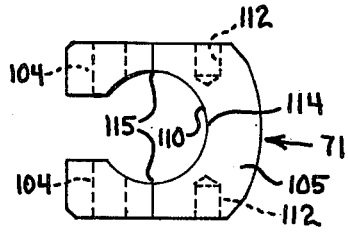
FIG. 7 is a bottom view of the operator element when positioned as shown in FIG. 5.

Referring to FIGS. 4, 5, 6, and 7, the cutter-valve operator element 71 is essentially a solid member comprising substantially less than one-fourth of a sphere generated about an axis 102 having spaced legs 103 provided with pivot pin bores 104 drilled through the legs along the axis 102. The operator element has a spherical surface 105 generated on the center 102. A bore 110 is formed through the body and legs of the element along an axis perpendicular to the axis 102 and eccentrically positioned in the member spaced toward the spherical surface 105. The bores 102 are provided for pivot pins about which the operator element rotates. The element 71 has opposite side faces 111 which are parallel with each other lying in planes perpendicular to the axis 102 and parallel with the axis of the bore 110. Blind outwardly opening return pin holes 112 are formed in the opposite side faces 110 spaced from and along a common axis parallel with the bores 104. The blind bores 112 are formed to receive pins which engage the operator element to return the element from the second closed cutting position to the first open position. The top face 113 of the operator element as seen in FIG. 4 is a flat plane surface perpendicular to the axis of the bore 110. As viewed from the bottom of the operator element as shown in FIG. 7, the surface 105 is seen bounded at the lower end of the bore 110 by the curved cutting edge 114 which encircles the bore 110 extending from bottom corner edges 115 defining a curved cutting edge for severing the coiled tubing or wireline extending through the tool. The surface 105 is finished to sealingly engage a seat surface on the member 75.

Figure 11:
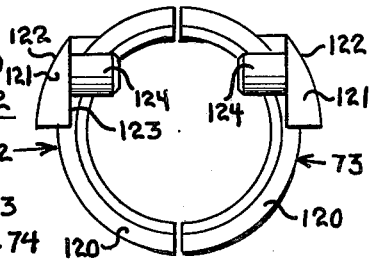
FIG. 11 is a top end view of the pivot arms as seen along the line 11—11 of FIG. 9.
Figure 12:
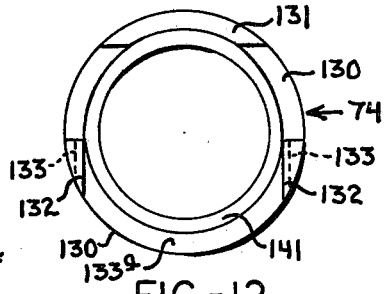
FIG. 12 is a top end view of the carrier frame as seen along the line 12—12 of FIG. 9.

The operator element 71 is rotatably supported on the pair of pivot arms 72 and 73 which have identical features and are mirror images of each other to fit on opposite sides of the operator element within the tool body for supporting the element. Each of the pivot arms has a semi-circular support or retainer ring 120 to which is secured an integral arm 121 which has a cylindrical outer surface portion 122 formed on a radius which conforms to the inner bore of the housing 34 of the tool body as evident in FIG. 11. Each of the arms 122 has a flat inside face 123. An integral pivot pin 124 is formed inside each of the arms 122 for engagement with the bore 104 of one of the legs of one of the elements 71 to rotatably support the element.

The carrier frame is a cylindrical integral member having a base ring 130, a cylindrical segment 131 extending upwardly from the base ring, equally spaced return arms 132 extending upwardly from the base ring and of a length equal to the cylindrical portion 131, and a cylindrical skirt portion 133*a* extending around the frame between the return arms 132. The outer shape and size of the frame including the surfaces bounding the portion 131 and the arms 132 are shaped and sized to slidably fit within the tool housing 34 as the frame must move longitudinally to return the operator element from the closed to the open position. Each of the return arms 132 has an internal transverse return pin recess 133 which receives return pins 134 secured in and projecting outwardly from the bores 112 in the operator element 71. The height of the recesses 133 as measured along the length of the return arms 132 is substantially greater than the diameter of the pins 134. The width of each of the recesses 133 as measured across or transverse to the length of the return arms permits the return pins 134 to slide in the slots 133 since the pins are rotating with the operator element 71 relative to the axis 102 while the carrier frame with the arms 132 and slots 133 moves longitudinally. The base ring 130 of the carrier frame has a bore 135 which is smaller in diameter than the bore 140 through the carrier frame to provide a stop shoulder 141 within the carrier frame engaged by the ring portions 120 on the pivot arms 121 when the pivot arms are installed within the carrier frame.

The seat 75 as seen in FIGS. 8 and 9 is a cylindrical member having an outer diameter sized to provide a sliding fit within the bore 135 of the base ring of the carrier frame. The upper end of the seat has a spherical seat surface 150 formed on an eccentrically positioned center relative to the axis of the cylindrical member 75 and coincident with the center and axis of rotation of the operator element 71 in the assembled relationship of the tool as shown in FIGS. 2A and 3B. The surface of the seat 150 including the edges of the member defining the seat are finished to provide both a cutting edge and a surface which will form an effective fluid seal with the spherical surface 105 of the operator element 71. The member 75 has an upper external annular recess 151 for the ring portions 120 of the pivot arms and a lower external annular recess 152 adapted to receive a split ring 153 as shown in FIGS. 2B and 3B which supports the lower end of the return spring 80.

The assembled relationship of the operating and supporting parts of the operator element 71 is shown in FIGS. 2A, 2B, 3A, 3B, and 4. The carrier frame 74 fits within the housing 34 with the upper end edges of the portion 131 and the return arms 132 engaging the bottom face 90 of the thrust ring 70. The arms 132 fit on opposite sides of the ramp portion 91 along the side faces 94 and 95. The end edges of the arms 132 are engageable with the bottom face portions 90*a* and 90*b* of the thrust ring. The seat member 75 is telescoped upwardly into the carrier frame with the upper recess 151 of the seat in the enlarged bore portion 140 of the carrier frame. The pivot arms 72 and 73 are positioned within the carrier frame with the ring portions 120 of the arms engaged in the upper recess 151 of the seat member 75. The cutter-valve operator element 71 is positioned within the carrier frame between the pivot arms 72 and 73. The pivot pins 124 within the arms engage the bores 104 of the operator element. The pivot pins are at off center or eccentric positions relative to the longitudinal axis of the housing of the tool. The return pins 134 of the element 71 engage the return slots 133 of the return arms 132 on the carrier frame. As shown in FIG. 3B the lower end portion of the seat member 75 is supported within an internal annular recess 154 provided in the upper end of the bottom sub 35. A ring seal 155 seals between the seat member and the bottom sub. The return spring 80 is confined around the seat member 75 between the lower end edge of the ring 130 on the carrier frame and the split retainer ring 153 engaged in the lower recess 152 of the seat member 75. During rotation the cutter-valve element 71 remains longitudinally fixed while rotating about the pivot pins 124 which are held by the pivot arms 72 and 73 engaged against longitudinal movement with the fixed seat member 75 which cannot move downwardly as the lower end of the seat member is engaged with the bottom sub 35. The carrier frame 74, however, is adapted to telescope downwardly on the seat member 75 against the force of the spring 80 when the element 71 is rotated by downward movement of the thrust ring.

The bores through the top sub 31, the annular piston 50, the thrust ring 70, the seat 75, and the bottom sub 35 are aligned along a common longitudinal axis defining a flow passage throughout the length of the tool 20. Such flow passage is large enough in size to accommodate the coiled tubing 30 represented in FIG. 1 as extending through the well tubing string 22 and the master valve 23 and well tool 20. The bore 110 through the operator element 71 is sized equal to the flow passage through the tool so that when the operator element is at the first open position as shown in FIG. 3B well operations may be carried out through the operator element including the extension of the coiled tubing through the element.

The well tool 20 may be used as a cutter for emergency severance of wirelines and coiled tubing strings. The tool may also function as a combined valve and cutter or simply as a valve. The primary purpose is, however, as a cutter used in tandem with a conventional master valve with the tool secondarily serving as a redundant valve thereby enhancing safety consideration. The tool is preferably installed on a well in the arrangement schematically shown in FIG. 1 with the tool 20 connected into the tubing string 22 in tandem with and below the master valve 23. The tool may be made up in the well head christmas tree so that the master valve, the tool 20, and the related required well head structure is lowered to and connected on the well as a unit communicating with the tubing string 22 to the surface. Typically the tool 20 is located as close as four to six feet below the master valve 23. Both the tool 20 and the master valve 23 are connected with suitable hydraulic fluid pressure sources at the surface through the lines 24 and 35 respectively. In a typical arrangement the master valve 23 is held open during well operations by a hydraulic fluid pressure source which is adapted to reduce the pressure as required such as by response to sensing conditions which may change in an emergency to allow the valve to automatically close. The normal condition of the tool 20, however, is open so that well servicing may be carried out through the bore of the tool. Thus, in the absence of sufficient hydraulic pressure applied through the line 24 the operator element 71 of the tool is open as shown in FIGS. 3A and 3B. In the absence of hydraulic pressure in the annular chamber 61 above the piston portion 51 the spring 80 holds the carrier frame 74 at an upper end position. The upper end of the spring 80 engages the lower end surface of the carrier frame while the upper end edges of the portion 131 and the arms 132 of the carrier frame engage the face 90 on the thrust ring 70. The arms 132 fit along opposite sides of the ramp portion 91 of the thrust ring with the end edges of arms engaging the face portion **90*a* and 90*b* of the thrust ring. The carrier frame thus holds the thrust ring at the upper end position shown in FIGS. 3A and 3B. The thrust ring holds the annular piston 50 at the upper end position illustrated. The upper end edge of the thrust ring engages the lower end edge of the reduced central body portion 42 of the tool body limiting the upward movement of the thrust ring to the position shown in FIG. 3B. The pivot arms 72 and 73 are longitudinally supported by engagement of the ring portions 120 of the arms in the external annular recess 151 of the seat member 75. The pins 124 on the pivot arms engage the bores 104 of the operator element 71 providing a longitudinally fixed eccentric mounting of the operator element on an axis of rotation. The return pins 134 in the bores 112 of the operator element 71 are engaged in the slots 133 of the carrier frame arms thereby holding the operator element 71 at the open position as shown in FIG. 3 at which the bore 110** of the operator element is aligned with the longitudinal flow passage through the tool body.

The open position of the operator element 71 as described permits the coiled tubing 30 to extend through the open master valve 23 and the open tool 20 downwardly in the tubing string 22 to provide the well servicing function to be performed by the coiled tubing. As previously discussed this may comprise acid treatment of the well, stimulating the well to assist in production, sand washing, and numerous other well servicing tasks made possible by use of the coiled tubing string. It will be apparent that with the coiled tubing disposed through the master valve 23 the master valve cannot be closed. Thus, if it is necessary to abandon the well in less than the time required to withdraw the coiled tubing string it is necessary that at least that portion of the coiled tubing string extending through the master valve be removed sufficiently to permit the master valve to close. In this event the hydraulic pressure in the line 24 is increased applying sufficient force in the chamber 61 above the annular portion 51 to force the annular piston 50 downwardly. The downward movement of the annular piston forces the thrust ring 70 downwardly. The lower end edge of the ramp portion 91 of the thrust ring along the face 92 engaging the face portion 105 on the operator element 71 rotates the operator element downwardly about the pivot pins 124 in the arms 72 and 73. The shape of the ramp portion 91 of the thrust ring including the end face 92, the curved corner portion 100, and the ramp faces 93 permits a smooth, firm application of the downward force of the thrust ring against the operator element. The operator element is rotated downwardly on the axis of the pins 124 to the closed cutting position shown in FIGS. 2A and 13. As viewed in FIGS. 3B, 2A, and 13, the operator element rotates clockwise about the pivot pins. As the operator element rotates the coiled tubing is first forced toward the left hand side of the flow passage through the tool as viewed in FIG. 13 and as the tubing engages the left wall of the flow passage and cutting edge 114 defining the lower end edge of the bore 110 through the operator element distorts and thereafter cuts into the coiled tubing mashing the opposite side walls of the tubing together, crimping the tubing until ultimately the tubing is completely severed as represented in FIG. 13. The scissor action between the cutting edge 114 of the operator element and the left hand edge 150*a* of the seat 150 produces a scissor type action with the coiled tubing severing the tubing fully as the cutting edge 114 of the operator element passes the inside edge 150*a* of the seat 150. In actual practice it has been found that an extremely clean concave cut across the upward extending lower end portion and a corresponding matching convex cut in the lower end portion of the upper section of the coiled tubing is produced as the tubing is fully severed. After the coiled tubing is cut as represented in FIG. 13 the coiled tubing extending from the operator element of the tool 20 to the surface is lifted upwardly a sufficient distance to raise it above the master valve 23 which is then permitted to close by relaxation of the hydraulic pressure in the line 25.

In rotating the operator element 71 to the closed cutting position of FIGS. 2A and 13 the rotating force is applied by the ramp of the thrust ring on a moment arm measured from the axis of the pins 124 along the line of contact between the shear ring and the face 105 of the operator element. The moment arm is greater in length than the equivalent moment arm in conventional ball valves which have been used in the past as cutting elements inasmuch as with such conventional ball valves the distance between the axis of rotation of the ball and the member applying the rotating force is generally substantially less than the radius of the bore of the tool housing. In contrast, in the present tool the moment arm due to the eccentric positioning of the axis of rotation of the operator element 71 may readily exceed the radius of the bore through the tool body. A substantially greater moment arm permits the application of a much greater force to perform the cutting action.

After the coiled tubing has been sheared by the operator element 71 the spherical surface of the operator element engages the seat 150 on the seat member 74 performing a valve action shutting off flow through the bore of the tool.

It will be seen from FIG. 2A that while the seat member 75 remains fixed longitudinally holding the pivot arms 72 and 73 along with the operator element 71 against downward movement while the operator element pivots to the cutting closed position, the carrier frame 74 is forced downwardly by the thrust ring relative to the seat member compressing the spring 80. The carrier frame telescopes downwardly on the seat member to a position at which the base ring portion 130 of the carrier frame is spaced below the ring portions 120 of the pivot arms as seen in FIG. 2A.

After the cutting and removal of the coiled tubing above the master valve 23 and with the master valve closed, the hydraulic pressure in the line 24 is reduced lowering the pressure in the chamber 61 above the annular piston portion 51. The spring 80 then expands lifting the carrier frame 74 back upwardly on the seat 75 to the position shown in FIG. 3B. As the carrier frame moves upwardly the return arms 132 which engage the return pins 134 in the operator element at the arm recesses 133 rotate the cutter element back to the open position. The pins 134 contact the lower edges of the recesses 133 of the arms 132 forcing the return pins upwardly rotating the operator element on the pivot pins 124 back to the position of FIG. 3B. The upward rotating motion of the operator element lifts the thrust ring 70 back upwardly raising the annular piston 50 back to the position shown in FIG. 3A.

It will now be appreciated that a new and improved well tool has been described which may function as a cutter for severing wireline, coiled tubing, and the like, as a valve, and as a combination cutter and valve. It will be further recognized that the cutter employs an operator element which has a spherical segment formed on a center eccentric to the central bore through the element with the element being rotatable on an axis positioned eccentrically with respect to the bore through the housing of the tool in which the element functions. The eccentric mounting of the operator element provides a moment arm for rotation of the element to provide a cutting function using maximum full force in a circular arc produced by a longitudinal force applied to the operator element.

It will be recognized that numerous modifications may be made in the well tool 20 within the scope of the invention. For example, if desired the tool may be operated by the same fluid pressure used to hold the safety valve open by using detent or shear pin means between the carrier frame and the housing 34 so that the annular piston 50 is movable downwardly at a predetermined pressure valve above the requirement to hold the safety valve open. Alternatively the spring 80 could be made strong enough to hold the operator element against closure below a desired pressure in the annular chamber 61.

What is claimed is:

1. A well tool comprising: a tubular body having an axially extending flow passage therethrough; means secured in said tubular body providing a spherical annular seat generated about a center positioned eccentric relative to the longitudinal axis of said flow passage; an operator element rotatably secured in said body on an eccentric axis coincident with said center of said spherical seat, said operator element having a spherical surface portion generated about an eccentric center coincident with the center of said spherical seat and having a bore therethrough having an axis spaced from said center of said spherical surface, said operator element being rotatable from a first open position at which said spherical surface engages a portion of said spherical seat surface and said bore through said operator element is aligned with said flow passage through said tubular body and a second closed position at which said bore is misaligned with said flow passage through said tubular body and said spherical surface on said operator element fully engages said spherical seat surface closing said flow passage through said tubular body; and an actuator member for rotating said operator element from said first position to said second position, said actuator member having a force applying surface engageable with said operator element along a surface on said operator element spaced from said eccentric axis of rotation of said operator element for rotating said operator element about said axis of rotation responsive to longitudinal movement of said actuator member.

2. A well tool in accordance with claim 1 wherein said operator element is a valve member adapted to permit flow through said flow passage of said tubular body at said first position and to close off flow through said flow passage at said second position.

3. A well tool in accordance with claim 1 wherein said operator element is a cutting member having a cutting edge around a portion of said bore through said element to coact with said spherical seat surface for shearing action with said seat surface as said operator element is rotated from said first to said second position.

4. A well tool in accordance with claim 3 wherein said operator element seats in sealed relationship with said spherical seat for performing a valve function to preclude flow through said tool when said operator element is at said second position.

5. A well tool in accordance with claim 1 wherein said operator element is provided with a spherical surface generated on a radius greater than the radius of the bore through said tubular body.

6. A well tool in accordance with claim 5 wherein said spherical surface on said operator element defines less than one-fourth of a sphere having an equal radius to said spherical surface.

7. A well tool in accordance with claim 6 wherein said operator element includes spaced support arms having aligned pivot pin holes formed along an axis coincident with the center about which said spherical surface is generated.

8. A well tool in accordance with claim 7 including return assembly means in said body coupled with said operator element for rotating said element from said second position back to said first position.

9. A well tool in accordance with claim 8 wherein said return assembly includes a slidable carrier frame longitudinally movable in said tubular body and having side arms extending along opposite side faces of said operator element, return pins coupling said side arms with said operator element and spaced from the axis of rotation of said operator element, and means for applying a force to said carrier frame for moving said carrier frame toward said operator element to rotate said operator element from said second position back to said first position.

10. A well tool in accordance with claim 9 wherein said return assembly includes a spring for applying a force to said carrier to return said carrier toward said operator element.

11. A well tool in accordance with claim 10 including a longitudinally movable thrust ring in said tubular body having a ramp portion engageable with said operator element for rotating said operator element from said first position to said second position, and means for applying a force to said thrust ring for urging said thrust ring toward said operator element.

12. A well tool comprising: a tubular body having a bore defining a flow passage therethrough; an annular piston slidably disposed in said tubular body; means for applying hydraulic fluid pressure to said annular piston to move said piston in said body; a thrust ring slidably disposed in said body coupled with said annular piston for movement in said body by said annular piston; an operator element having a spherical surface portion generated about a center coincident with a transverse axis of rotation of said operator element extending across said tubular body positioned in eccentric relationship with the longitudinal axis of said bore through said body, said operator element having a bore therethrough formed along an axis perpendicular to the axis of rotation of said operator element and spacef between said center of said spherical surface and said spherical surface, said bore through said operator element being in communication with said flow passage through said tubular body at a first position of rotation of said operator element and being misaligned in noncommunicating relationship with said bore through said tubular body at a second position of rotation of said operator element; a tubular seat member secured in said tubular body coincident with the axis of the bore of said body on the opposite side of said operator element from said thrust ring, said seat member having a spherical end seat surface formed on an eccentric center coincident with the center of said spherical surface of said operator element, said seat surface being engageable by said spherical surface of said operator element; pivot arms secured around said seat member on opposite sides of said operator element provided with pivot pins engaged with said operator element along a transverse axis coincident with the center of said spherical surface of said operator element for providing rotational support of said operator element; return pins secured in opposite sides of said operator element; a carrier frame secured around said operator element within said tubular body having end surfaces engageable with said thrust ring and having side return arms provided with transverse slots receiving said return pins on said operator element for engaging said return pins and rotating said operator element from second position of rotation back to a first position of rotation, said carrier frame being adapted to telescope along said pivot arms and said seat member responsive to movement of said thrust ring as said operator element moves between said first and second positions; and spring means coupled between said seat member and said carrier frame for urging said carrier frame toward said operator element to rotate said operator element back from said second position to said first position.

13. A well tool in accordance with claim 12 wherein said operator element is provided with a cutting edge surface around a portion of said bore through said element and said seat surface on said seat member is provided with a cutting edge for coacting with said cutting edge on said operator element for providing a shearing action between said operator element and said seat surface as said operator element is rotated from said first to said second position.

14. A well tool comprising: a tubular body having an axially extending flow passage therethrough; means secured in said tubular body along said flow passage providing a spherical seat surface generated about a center positioned eccentric relative to the longitudinal axis of said flow passage; an operator element rotatably secured in said body on an eccentric axis coincident with said center of said spherical seat, said operator element having a spherical surface portion generated about an eccentric center coincident with the center of said spherical seat and having a bore therethrough having an axis spaced from said center of said spherical surface, said operator element being rotatable relative to said seat surface between a first open position at which said bore through said operator element is aligned with said flow passage through said tubular body and a second closed position at which said bore is misaligned from said flow passage through said tubular body; and an actuator member for rotating said operator element from said first position to said second position, said actuator member having a force applying surface engageable with said operator element along a surface on said operator element spaced from said eccentric axis of rotation of said operator element for rotating said operator element about said axis of rotation responsive to longitudinal movement of said actuator member.

15. A well tool in accordance with claim 14 wherein said operator element is a cutting member having a cutting edge around a portion of said bore through said member to coact with said spherical seat surface for shearing action with said seat surface as said operator element is rotated from said first to said second position.

16. A well tool in accordance with claim 15 wherein said operator element seats in a sealed relationship with said spherical seat surface for performing a valve function to preclude flow through said tool when said operator element is at said second position.

17. A well tool comprising: a tubular body having an axially extending flow passage therethrough; means secured in said tubular body providing a spherical annular seat generated about a center positioned eccentric relative to the longitudinal axis of said flow passage; an operator element rotatably secured in said body on an eccentric axis coincident with said center of said spherical seat, said operator element having a spherical surface portion generated about an eccentric center coincident with the center of said spherical seat and having a bore therethrough having an axis spaced from said center of said spherical surface, said operator element being rotatable relative to said seat surface between a first open position at which said bore through said operator element is aligned with said flow passage through said tubular body and a second closed position at which said bore is misaligned from said flow passage through said tubular body; and an actuator member for rotating said operator element from said first position to said second position, said actuator member having a force applying surface engageable with said operator element along a surface on said operator element spaced from said eccentric axis of rotation of said operator element for rotating said operator element about said axis of rotation responsive to longitudinal movement of said actuator member.

18. A well tool in accordance with claim 17 wherein said operator element is a cutting member having a cutting edge around a portion of said bore through said member to coact with said spherical seat for shearing action with said seat as said operator element is rotated from said first to said second position.

19. A well tool is in accordance with claim 18 wherein said operator element seats in a sealed relationship with said spherical seat for performing a valve function to preclude flow through said tool when said operator element is at said second position.

* * * * *